US009799292B2

(12) United States Patent
Cao

(10) Patent No.: US 9,799,292 B2
(45) Date of Patent: Oct. 24, 2017

(54) LIQUID CRYSTAL DISPLAY DRIVING CIRCUIT

(71) Applicant: Shenzhen China Star Optoelectronics Technology Co., Ltd., Shenzhen, Guangdong (CN)

(72) Inventor: Shangcao Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 240 days.

(21) Appl. No.: 14/436,591

(22) PCT Filed: Jan. 16, 2015

(86) PCT No.: PCT/CN2015/070925

§ 371 (c)(1),
(2) Date: Apr. 17, 2015

(87) PCT Pub. No.: WO2016/106870

PCT Pub. Date: Jul. 7, 2016

(65) Prior Publication Data

US 2016/0351149 A1 Dec. 1, 2016

(30) Foreign Application Priority Data

Dec. 31, 2014 (CN) ..... 2014 1 0856540

(51) Int. Cl.
*G09G 3/36* (2006.01)

(52) U.S. Cl.
CPC ... *G09G 3/3677* (2013.01); *G09G 2310/0283* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

2008/0186267 A1* 8/2008 Mamba ..... G09G 3/3655 345/87
2011/0140752 A1* 6/2011 Garg ..... H03K 3/0315 327/291

* cited by examiner

*Primary Examiner* — Tony N Ngo
(74) *Attorney, Agent, or Firm* — Andrew C. Cheng

(57) ABSTRACT

A liquid crystal display driving circuit comprising a scan control module, a gate driving signal output module and a stage transmission module. A voltage for controlling forward and reverse scan is inputted to the voltage level control input terminal of the scan control module; an output terminal of the scan control module outputs a scan control signal to the output control signal of the gate driving signal output module and the stage transmission module; the gate driving signal output module comprises first gate driving signal output submodule, a second gate driving signal output submodule and a first inverter; a CK1 signal is inputted to a clock input terminal of the first gate driving signal output submodule; a CK2 signal is inputted to a clock input terminal of the second gate driving signal output submodule; a CKV signal is inputted to a clock input terminal of the stage transmission module.

16 Claims, 4 Drawing Sheets

LIQUID CRYSTAL DISPLAY DRIVING CIRCUIT

CROSS REFERENCE TO RELATED APPLICATIONS

This application claims the benefit of, and priority to, Chinese Patent Application No. 201410856540.X, filed Dec. 31, 2014, titled "Liquid Crystal Display Driving Circuit", the entire contents of which are incorporated by reference herein in its entirety.

FIELD OF THE INVENTION

The disclosure is related to the field of liquid crystal display, and more particularly to a liquid crystal display driving circuit.

BACKGROUND OF THE INVENTION

The liquid display devices show the development trends of the highly integration and low cost in recent years. Achieving mass production of the gate driver on array (GOA) is one of the important technologies. The gate driver on array technology sues the existing front-end array process of the thin-film transistor liquid crystal display. The gate line scanning driver signal circuit is made on the array substrate of the thin-film transistor to achieve the driving technology for the progressive line scanning on the gate. Using the gate driver on array technology to integrate the gate line scanning driver signal circuit on the array substrate of the thin-film transistor can save the portion of the gate driver integrated circuit and thereby reduce product cost from the cost of materials and production process. This kind of using the gate driver on array technology to integrate the gate line scanning driver signal circuit on the array substrate of the thin-film transistor can also be called the gate line scanning driver signal circuit. There are some issues existing in the current GOA circuit. The current stage gate driving signal is used as a trigger signal for generating the next stage gate driving signal. This results in the instable stage transmission of the GOA circuit.

SUMMARY OF THE INVENTION

The embodiment of the disclosure provides a liquid crystal display driving circuit to achieve the separation of the stage transmission signal and the gate driving signal and increase the stability of the stage transmission of the driving circuit.

According to an embodiment of the disclosure, the disclosure provides a liquid crystal display driving circuit comprises a scan control module, a gate driving signal output module and a stage transmission module;

wherein a voltage for controlling forward scan and reverse scan is inputted to the voltage level control input terminal of the scan control module; a stage transmission signal input terminal of the scan control module receives a stage transmission signal of the previous stage output from the stage transmission module; an output terminal of the scan control module outputs a scan control signal to an input terminal of the output control signal of the gate driving signal output module and an stage transmission control signal input terminal of the stage transmission module respectively;

wherein the gate driving signal output module comprises first gate driving signal output submodule, a second gate driving signal output submodule and a first inverter; the scan control module outputs the scan control signal to an input terminal of the submodule output control signal of the first gate driving signal output submodule and an input terminal of the submodule output control signal of the second gate driving signal output submodule through the first inverter; a CK1 signal is inputted to a clock input terminal of the first gate driving signal output submodule; a CK2 signal is inputted to a clock input terminal of the second gate driving signal output submodule;

wherein a CKV signal is inputted to a clock input terminal of the stage transmission module;

wherein the clock periods of the CK1 signal and CK2 signal are half of the clock period of the CKV signal; the occurrence time of the high voltage level of the CK1 signal does not overlap with the occurrence time of the high voltage level of the CK2 signal.

The scan control module of the disclosure receives a stage transmission signal of the previous stage output from the stage transmission module; the scan control module outputs the stage transmission signal to the stage transmission module and the gate driving signal module respectively. When the stage transmission module receives the CKV signal with the low voltage level, the stage transmission module outputs the stage transmission signal of the current stage. When the gate driving signal receives the CK1 and CK2 signal with the high voltage level respectively, the gate driving signal module outputs the two stage gate driving signal. The embodiment of the disclosure achieves the separation of the stage transmission and the gate driving signal and increases the stability of the stage transmission of the driving circuit.

BRIEF DESCRIPTION OF THE DRAWINGS

In order to more clearly illustrate the prior art or the embodiments or aspects of the practice of the disclosure, the accompanying drawings for illustrating the prior art or the embodiments of the disclosure are briefly described as below. It is apparently that the drawings described below are merely some embodiments of the disclosure, and those skilled in the art may derive other drawings according the drawings described below without creative endeavor.

DETAILED DESCRIPTION OF PREFERRED EMBODIMENTS

The following description with reference to the accompanying drawings is provided to clearly and completely explain the exemplary embodiments of the disclosure. It is apparent that the following embodiments are merely some embodiments of the disclosure rather than all embodiments of the disclosure. According to the embodiments in the disclosure, all the other embodiments attainable by those skilled in the art without creative endeavor belong to the protection scope of the disclosure.

Figure 1:
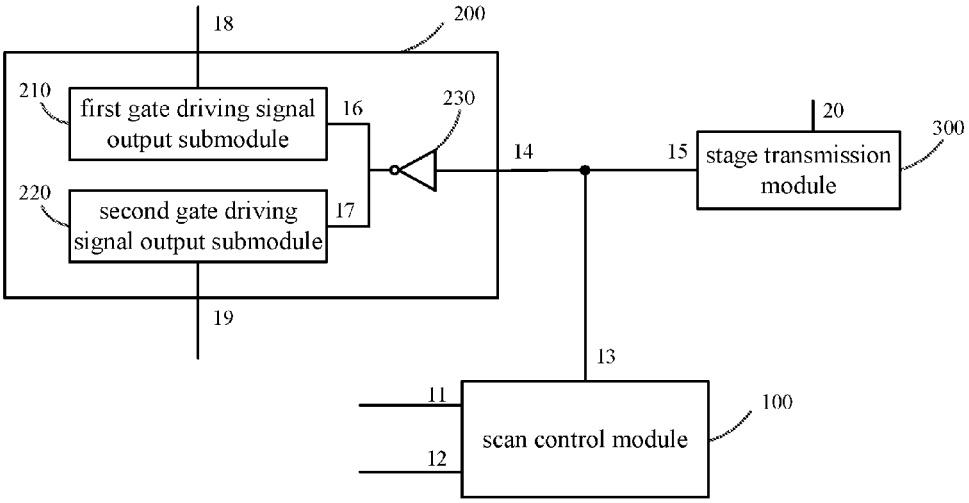
FIG. 1 is a schematic diagram of the liquid crystal display driving circuit of the disclosure.

FIG. 1 is a schematic diagram of the liquid crystal display driving circuit of the disclosure. As shown in the figure, the liquid crystal display driving circuit comprises a scan control module 100, a gate driving signal output module 200 and a stage transmission module 300. A voltage for controlling forward scan and reverse scan is inputted to the voltage level control input terminal 11 of the scan control module 100. A stage transmission signal input terminal 12 of the scan control module 100 receives a stage transmission signal of the previous stage output from the stage transmission module. An output terminal 13 of the scan control module 100 outputs a scan control signal to an input terminal 14 of the output control signal of the gate driving signal output module 200 and a stage transmission control signal input terminal 15 of the stage transmission module 300 respectively.

The gate driving signal output module 200 comprises a first gate driving signal output submodule 210, a second gate driving signal output submodule 220 and a first inverter 230. The scan control module 100 outputs the scan control signal to an input terminal 16 of the submodule output control signal of the first gate driving signal output submodule 210 and an input terminal 17 of the submodule output control signal of the second gate driving signal output submodule 220 through the first inverter 230. A CK1 signal is inputted to a clock input terminal 18 of the first gate driving signal output submodule 210. A CK2 signal is inputted to a clock input terminal 19 of the second gate driving signal output submodule 220.

A CKV signal is inputted to a clock input terminal 20 of the stage transmission module 300. The clock periods of the CK1 signal and CK2 signal are half of the clock period of the CKV signal. The occurrence time of the high voltage level of the CK1 signal does not overlap with the occurrence time of the high voltage level of the CK2 signal.

The scan control module of the disclosure receives a stage transmission signal of the previous stage output from the stage transmission module; the scan control module outputs the stage transmission signal to the stage transmission module and the gate driving signal module respectively. When the stage transmission module receives the CKV signal with the low voltage level, the stage transmission module outputs the stage transmission signal of the current stage. When the gate driving signal receives the CK1 and CK2 signal with the high voltage level respectively, the gate driving signal module outputs the two stage gate driving signals. The embodiment of the disclosure achieves the separation of the stage transmission and the gate driving signal and increases the stability of the stage transmission of the driving circuit.

Figure 2:
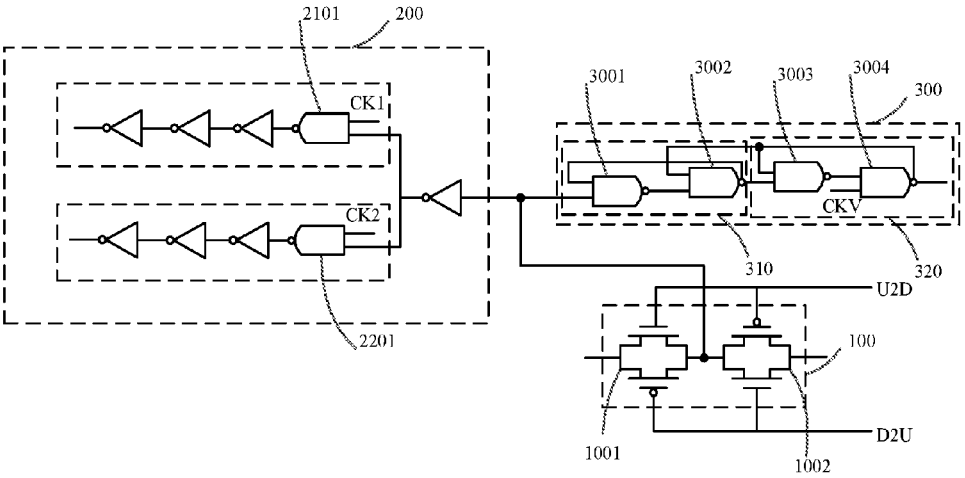
FIG. 2 is a schematic diagram of the liquid crystal display driving circuit according to another embodiment of the disclosure.

FIG. 2 is a schematic diagram of the liquid crystal display driving circuit according to another embodiment of the disclosure.

As shown in the figure, the stage transmission module 300 comprises a first NAND gate 3001, a second NAND gate 3002, a third NAND gate 3003 and a fourth NAND gate 3004. A first input terminal of the first NAND gate 3001 receives the scan control signal output from the scan control module 100. A first input terminal of the second NAND gate 3002 electrically connects to an output terminal of the first NAND gate 3001. A first input terminal of the third NAND gate 3003 electrically connects to an output terminal of the second NAND gate 3002. A first input terminal of the fourth NAND gate 3004 electrically connects to an output terminal of the third NAND gate 3002. A second input terminal of the first NAND gate 3001 electrically connects to an output terminal of the second NAND gate 3002. A second input terminal of the second NAND gate 3002 and the third NAND gate 3003 electrically connects to an output terminal of the fourth NAND gate 3004 respectively. The second input terminal of the fourth NAND gate 304 connects to the CKV signal, and the output terminal of the fourth NAND gate 3004 outputs the stage transmission signal.

The stage transmission module 300 comprises a latch submodule 310 and a stage transmission signal generating submodule 320. The latch submodule 310 comprises the first NAND gate 3001 and the second NAND gate 3002. In order to ensure producing the driving signal of the current stage and the next stage, the corresponding stage transmission signal of the current stage is high voltage level such that the gate driving signal outputs module of the current stage cannot be effected by the CK1 and CK2 signal. The stage transmission signal generating submodule 320 comprises the third NAND gate 3003 and the fourth NAND gate 3004 to generate the stage transmission signal.

The first gate driving signal output submodule comprises a ninth NAND gate 2101 and a plurality of odd number of inverters. A first input terminal of the ninth NAND gate 2101 receives the scan control signal outputted from the scan control module and reversed by the first inverter 230. The CK1 signal is inputted to a second output terminal of the ninth NAND gate 2101. The plurality of odd number of inverters is configured by the connection that an input terminal of the former inverter connects to an output terminal of the latter inverter. An input terminal of the first inverter connects to the output terminal of the ninth NAND gate 2101. An output terminal of the last inverter outputs the gate driving signal.

The second gate driving signal output submodule comprises a tenth NAND gate 2201 and a plurality of odd number of inverters. A first input terminal of the tenth NAND gate 2201 receives the scan control signal outputted from the scan control module and reversed by the first inverter 230. The CK2 signal is inputted to a second output terminal of the tenth NAND gate 2201. The plurality of odd number of inverters is configured by the connection that an input terminal of the former inverter connects to an output terminal of the latter inverter. An input terminal of the first inverter connects to the output terminal of the tenth NAND gate. An output terminal of the last inverter outputs the gate driving signal.

The scan control module 100 comprises a first transmitter 1001 and a second transmitter 1002. The control voltage level input terminal of the scan control module 100 comprises a first control voltage level input terminal and a second control voltage level input terminal. The first control voltage level input terminal and the second control voltage level input terminal connect to a forward scan control voltage U2D and a reverse scan control voltage D2U respectively. The driving circuit is a forward scan state when the forward scan control voltage U2D is in high voltage level and the reverse scan control voltage D2U is low voltage level. The driving circuit is in a reverse scan state when the forward scan control voltage U2D is low voltage level and the reverse scan control voltage D2U is high voltage level.

The stage transmission signal input terminal of the scan control module 100 comprises a first stage transmission signal input terminal and a second stage transmission signal input terminal. The first stage transmission signal input terminal receives the stage transmission signal of the former stage transmission module. The second stage transmission signal input terminal receives the stage transmission signal of the next stage transmission module.

In the embodiment of the disclosure, the scan control module 100 receives the former stage transmission signal from the stage transmission module and outputs the stage transmission signal to the stage transmission module and the gate driving signal module respectively. The stage transmission module receives the CKV signal with the low voltage level and outputs the stage transmission signal of the current stage. The gate driving signal module receives the CK1 and CK2 signal with the high voltage level and outputs the two stage gate driving signals. The embodiment of the disclosure achieves the separation of the stage transmission and the gate driving signal and increases the stability of the stage transmission of the driving circuit.

Figure 3:
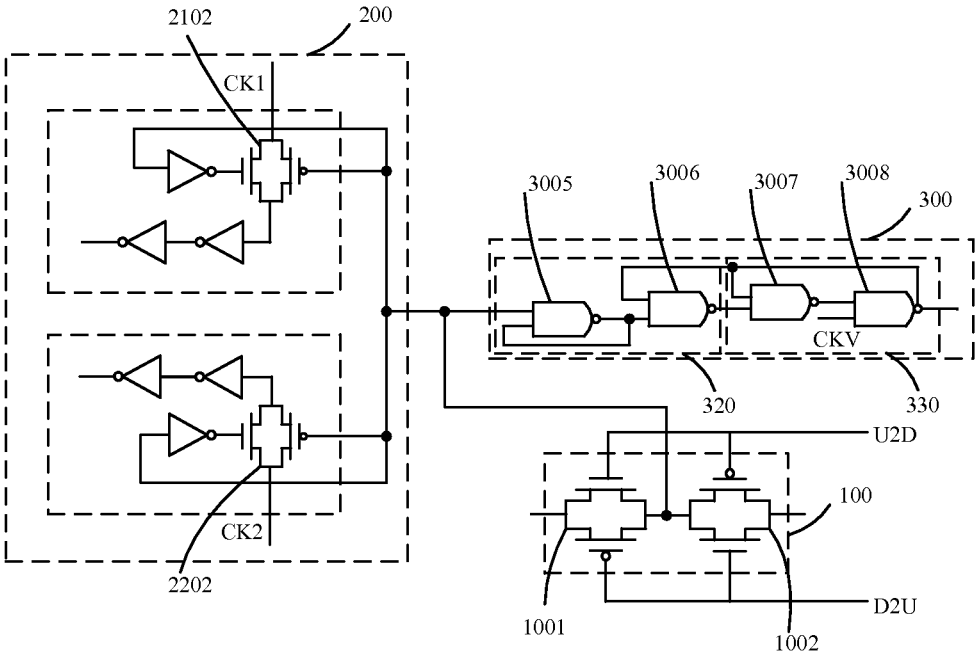
FIG. 3 is a diagram view of the liquid crystal display driving circuit according to another embodiment of the disclosure.

FIG. 3 is a schematic diagram of the liquid crystal display driving circuit according to another embodiment of the disclosure.

As shown in the figure, the stage transmission module comprises a fifth NAND gate 3005, a sixth NAND gate 3006, a seventh NAND gate 3007 and a eighth NAND gate 3008. A first input terminal of the fifth NAND gate 3005 receives the scan control signal 100 outputted from the scan control module. An output terminal of the fifth NAND gate 3005 electrically connects to a second input terminal of the fifth NAND gate 3005 and a first input terminal of the sixth NAND gate 3006 respectively. A first input terminal of the seventh NAND gate 3007 electrically connects to an output terminal of the sixth NAND gate 3006. A first input terminal of the eighth NAND gate 3008 electrically connects to an output terminal of the seventh NAND gate 3007. A second input terminal of the sixth NAND gate 3006 and a second input terminal of the seventh NAND gate 3007 electrically connects to an output terminal of the eighth NAND gate 3008 respectively. The CKV signal is inputted to a second input terminal of the eighth NAND gate 3008. The output terminal of the eighth NAND gate 3008 outputs the stage transmission signal.

The stage transmission module 300 comprises a latch submodule 320 and a stage transmission signal generating submodule 330. The latch submodule 320 comprises the fifth NAND gate 3005 and the sixth NAND gate 3006. In order to ensure producing the driving signal of the current stage and the next stage, the corresponding stage transmission signal of the current stage is high voltage level such that the gate driving signal output module of the current stage cannot be effected by the CK1 and CK2 signal. The stage transmission signal generating submodule 330 comprises the seventh NAND gate 3007 and the eighth NAND gate 3008 to generate the stage transmission signal.

The first gate driving signal output submodule comprises a first transmitter 2102 and an even number of inverters. The first transmitter 2102 comprises a P-channel enhancement type field effect transistor and an N-channel enhancement type field effect transistor. The even number of inverters is configured by the connection that an input terminal of the former inverter connects with an output terminal of the latter inverter. An input terminal of the first inverter connects the source of the P-channel enhancement type field effect transistor and the source of the N-channel enhancement type field effect transistor in the first transmitter 2102. An output terminal of the last inverter outputs the gate driving signal. The drain of the P-channel enhancement type field effect transistor and the drain of the N-channel enhancement type field effect transistor in the first transmitter 2102 connects to the CK1 signal.

The second gate driving signal output submodule comprises a second transmitter 2202 and an even number of inverters. The second transmitter 2202 comprises a P-channel enhancement type field effect transistor and an N-channel enhancement type field effect transistor. The even number of inverters configured by the connection that an input terminal of the former inverter connects with an output terminal of the latter inverter. An input terminal of the first inverter connects to the source of the P-channel enhancement type field effect transistor and the source of the N-channel enhancement type field effect transistor in the second transmitter 2202. An output terminal of the last inverter outputs the gate driving signal. The drain of the P-channel enhancement type field effect transistor and the drain of the N-channel enhancement type field effect transistor in the second transmitter 2202 connect to the CK2 signal.

The control voltage level input terminal of the scan control module 100 comprises a first control voltage level input terminal and a second control voltage level input terminal. The first control voltage level input terminal and the second control voltage level input terminal connect to a forward scan control voltage U2D and a reverse scan control voltage D2U respectively. The driving circuit is a forward scan state when the forward scan control voltage U2D is in high voltage level and the reverse scan control voltage D2U is low voltage level. The driving circuit is in a reverse scan state when the forward scan control voltage U2D is low voltage level and the reverse scan control voltage D2U is high voltage level.

The stage transmission signal input terminal of the scan control module 100 comprises a first stage transmission signal input terminal and a second stage transmission signal input terminal. The first stage transmission signal input terminal receives the stage transmission signal of the former stage transmission module. The second stage transmission signal input terminal receives the stage transmission signal of the next stage transmission module.

In the embodiment of the disclosure, the scan control module 100 receives the former stage transmission signal from the stage transmission module and outputs the stage transmission signal to the stage transmission module and the gate driving signal module respectively. The stage transmission module receives the CKV signal with the low voltage level and outputs the stage transmission signal of the current stage. The gate driving signal module receives the CK1 and CK2 signal with the high voltage level and outputs the two stage gate driving signals. The embodiment of the disclosure achieves the separation of the stage transmission and the gate driving signal and increases the stability of the stage transmission of the driving circuit.

Figure 4:
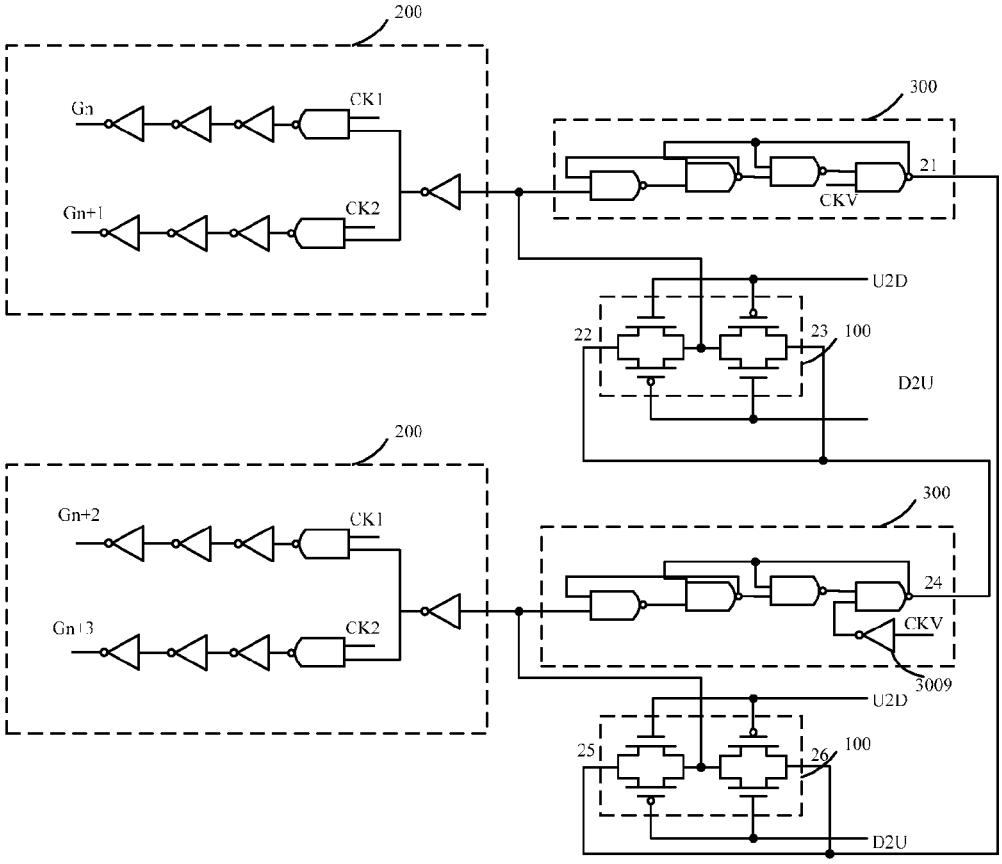
FIG. 4 is a diagram view of the liquid crystal display driving circuit according to another embodiment of the disclosure.
Figure 5:
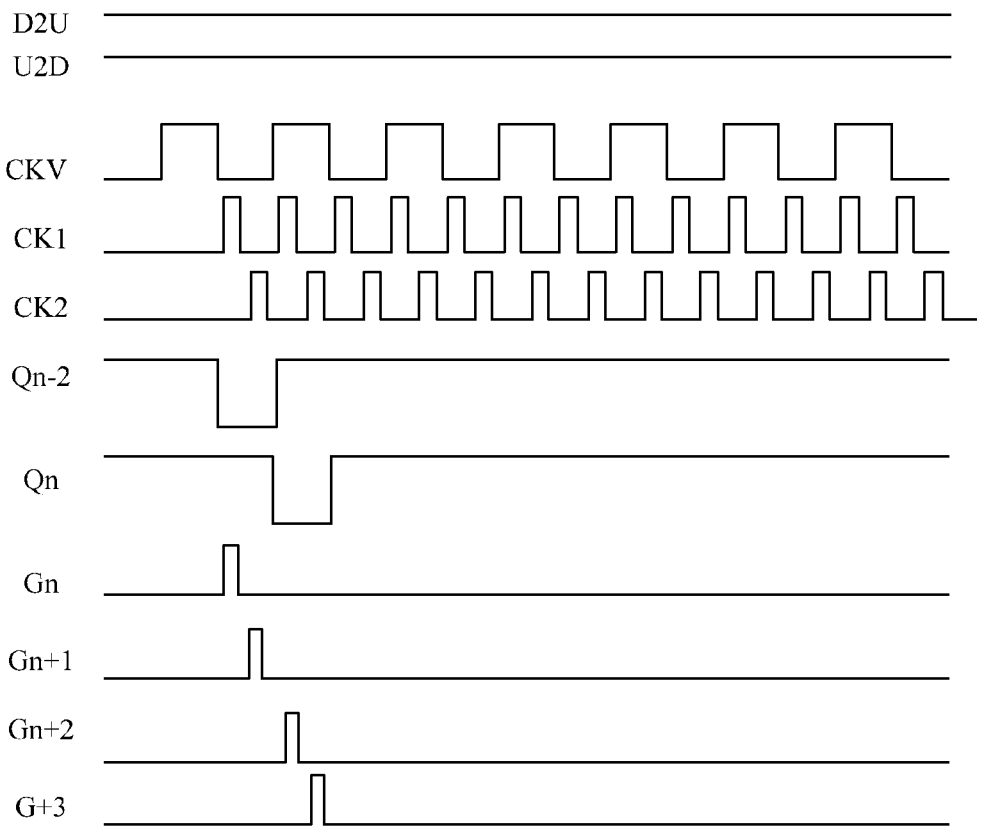
FIG. 5 is a timing chart of the liquid crystal display driving circuit of the disclosure.

FIG. 4 is a schematic diagram of the liquid crystal display driving circuit according to another embodiment of the disclosure. FIG. 5 is a timing chart of the liquid crystal display driving circuit of the disclosure.

Refer to FIG. 4. The driving circuit is configured by connection of the two stage of the liquid crystal display driving circuit. The stage transmission signal output terminal of the stage transmission module of the current stage connects to the first input terminal 25 and the second input terminal 26 of the stage transmission module of the next stage. The stage transmission signal output terminal 24 of the stage transmission module of the next stage connects to the first input terminal 22 and the second input terminal 23 of the stage transmission module of the current stage. The stage transmission module of the driving circuit of the next stage comprises a second NAND gate 3009. When the CKV signal is high voltage level, the clock input terminal of the stage transmission receives the CKV signal with the low voltage level reversed by a second inverter.

When the driving circuit is in a reverse scan state, the first stage transmission signal input terminal 21 receives the former stage transmission signal from the stage transmission module. When the former stage transmission signal is the low voltage level, the scan control module of the current stage outputs the scan control signal Qn−2 with the low voltage level to the input terminal of the output control signal of the gate driving signal output module of the current stage and the stage transmission control signal input terminal of the stage transmission module respectively.

After the stage transmission module receives the stage transmission signal Qn−2 with the low voltage level, the stage transmission module generates the stage transmission signal Qn of the current stage when receiving the CKV signal with the low voltage level. An input terminal of the submodule output control signal of the first gate driving signal output submodule and an input terminal of the submodule output control signal of the second gate driving signal output submodule respectively receive the scan control signal with the low voltage level reversed by the first inverter. When a clock input terminal of the first gate driving signal output submodule receives the CK1 signal with the high voltage level, an clock input terminal of the second gate driving signal output submodule receives the CK2 signal with the low voltage level, the first gate driving signal output submodule outputs the driving signal Gn+1 to drive the gate of the stage. When the clock input terminal of the first gate driving signal output submodule receives the CK1 signal with the low voltage level, the clock input terminal of the second gate driving signal output submodule receives the CK2 signal with the high voltage level, the second gate driving signal output submodule outputs the driving signal Gn+1 to drive the gate of the next stage.

After the stage transmission module receives the stage transmission signal Qn with the low voltage level, the stage transmission module generates the stage transmission signal Qn+2 of the current stage when receiving the CKV signal with the high voltage level. The first input terminal 25 and the second input terminal 26 of the stage transmission module of the next stage receives the stage transmission signal Qn of the current stage with the low voltage level. In the next stage driving circuit, the input terminal of the submodule output control signal of the first gate driving signal output submodule and an input terminal of the submodule output control signal of the second gate driving signal output submodule respectively receive the scan control signal with the low voltage level reversed by the first inverter of the next stage driving circuit. When an clock input terminal of the first gate driving signal output submodule of the next stage driving circuit receives the CK1 signal with the high voltage level, an clock input terminal of the second gate driving signal output submodule of the next stage driving circuit receives the CK2 signal with the low voltage level, the first gate driving signal output submodule of the next stage driving circuit outputs the driving signal Gn+2 to drive the gate of the current stage. When the clock input terminal of the first gate driving signal output submodule of the next stage driving circuit receives the CK1 signal with the low voltage level, the clock input terminal of the second gate driving signal output submodule receives the CK2 signal with the high voltage level, the second gate driving signal output submodule of the next stage driving circuit outputs the driving signal Gn+3 to drive the gate of the next stage.

When the driving circuit is during the reverse scan, the stage transmission signal input terminal of the stage transmission module receives the stage transmission control signal with the low voltage level. When the clock input terminal of the stage transmission module receives the CKV signal with the low voltage level, the stage transmission module outputs the stage transmission signal of the current stage with the high voltage level.

The first stage transmission signal input terminal receives the next stage transmission signal from the stage transmission module; when the former stage transmission signal is the low voltage level, the scan control module outputs the scan control signal with the low voltage level to the input terminal of the output control signal of the gate driving signal output module and the stage transmission control signal input terminal of the stage transmission module respectively.

After the stage transmission module receives the stage transmission signal Qn+2 with the low voltage level, the stage transmission module generates the stage transmission signal Qn of the current stage when receiving the CKV signal with the low voltage level. The input terminal of the submodule output control signal of the first gate driving signal output submodule and the input terminal of the submodule output control signal of the second gate driving signal output submodule respectively receive the scan control signal with the low voltage level reversed by the first inverter. When the clock input terminal of the first gate driving signal output submodule receives the CK1 signal with the high voltage level, the clock input terminal of the second gate driving signal output submodule receives the CK2 signal with the low voltage level, the first gate driving signal output submodule outputs the driving signal Gn+3 to drive the gate of the stage. When the clock input terminal of the first gate driving signal output submodule receives the CK1 signal with the low voltage level, the clock input terminal of the second gate driving signal output submodule receives the CK2 signal with the high voltage level, the second gate driving signal output submodule outputs the driving signal Gn+2 to drive the gate of the former stage.

After the stage transmission module receives the stage transmission signal Qn with the low voltage level, the stage transmission module generates the stage transmission signal Qn−2 of the current stage when receiving the CKV signal with the high voltage level. The first input terminal 25 and the second input terminal 26 of the stage transmission module of the next stage receives the stage transmission signal Qn of the current stage with the low voltage level. In the next stage driving circuit, the input terminal of the submodule output control signal of the first gate driving signal output submodule and an input terminal of the submodule output control signal of the second gate driving signal output submodule respectively receive the scan control signal with the low voltage level reversed by the first inverter of the next stage driving circuit. When an clock input terminal of the first gate driving signal output submodule of the next stage driving circuit receives the CK1 signal with the high voltage level, an clock input terminal of the second gate driving signal output submodule of the next stage driving circuit receives the CK2 signal with the low voltage level, the first gate driving signal output submodule of the next stage driving circuit outputs the driving signal Gn+1 to drive the gate of the current stage. When the clock input terminal of the first gate driving signal output submodule of the next stage driving circuit receives the CK1 signal with the low voltage level, the clock input terminal of the second gate driving signal output submodule receives the CK2 signal with the high voltage level, the second gate driving signal output submodule of the next stage driving circuit outputs the driving signal Gn to drive the gate of the next stage.

The stage transmission signal input terminal of the stage transmission module receives the stage transmission control signal with the low voltage level. When the clock input terminal of the stage transmission module receives the CKV signal with the low voltage level, the stage transmission module output the stage transmission signal of the current stage with the high voltage level.

When the driving circuit is during the inverse scan, the stage transmission signal generating the high voltage level outputting signal of the first and the second stage is the low voltage level. When the driving circuit is during the reverse scan, the stage transmission signal for generating the high voltage level output signal of the last and the penultimate stage is the low voltage level.

The scan control module of the disclosure receives a stage transmission signal of the previous stage output from the stage transmission module; the scan control module outputs the stage transmission signal to the stage transmission module and the gate driving signal module respectively. When the stage transmission module receives the CKV signal with the low voltage level, the stage transmission module outputs the stage transmission signal of the current stage. When the gate driving signal receives the CK1 and CK2 signal with the high voltage level respectively, the gate driving signal module outputs the two stage gate driving signal. The embodiment of the disclosure achieves the separation of the stage transmission and the gate driving signal and increases the stability of the stage transmission of the driving circuit.

Note that the specifications relating to the above embodiments should be construed as exemplary rather than as limitative of the present disclosure. The equivalent variations and modifications on the structures or the process by reference to the specification and the drawings of the disclosure, or application to the other relevant technology fields directly or indirectly should be construed similarly as falling within the protection scope of the disclosure.

What is claimed is:

1. A liquid crystal display driving circuit, comprising:

a scan control module;

a gate driving signal output module; and a stage transmission module;

wherein a voltage for controlling a forward scan and a reverse scan is inputted to a control voltage level input terminal of the scan control module; a stage transmission signal input terminal of the scan control module receives a stage transmission signal of the previous stage output from the stage transmission module; an output terminal of the scan control module outputs a scan control signal to an input terminal of the output control signal of the gate driving signal output module and an stage transmission control signal input terminal of the stage transmission module respectively;

wherein the gate driving signal output module comprises a first gate driving signal output submodule, a second gate driving signal output submodule and a first inverter; the scan control module outputs the scan control signal to an input terminal of the submodule output control signal of the first gate driving signal output submodule and an input terminal of the submodule output control signal of the second gate driving signal output submodule through the first inverter; a CK1 signal is inputted to a clock input terminal of the first gate driving signal output submodule; a CK2 signal is inputted to a clock input terminal of the second gate driving signal output submodule;

wherein a CKV signal is inputted to a clock input terminal of the stage transmission module;

wherein the clock periods of the CK1 signal and CK2 signal are half of the clock period of the CKV signal; the occurrence time of the high voltage level of the CK1 signal does not overlap with the occurrence time of the high voltage level of the CK2 signal;

wherein the control voltage level input terminal of the scan control module comprises a first control voltage level input terminal and a second control voltage level input terminal; the first control voltage level input terminal and the second control voltage level input terminal connect to a forward scan control voltage U2D and a reverse scan control voltage D2U respectively;

wherein, the driving circuit is a forward scan state when the forward scan control voltage U2D is in high voltage level and the reverse scan control voltage D2U is low voltage level; the driving circuit is in a reverse scan state when the forward scan control voltage U2D is low voltage level and the reverse scan control voltage D2U is high voltage level;

wherein the stage transmission signal input terminal of the scan control module comprises a first stage transmission signal input terminal and a second stage transmission signal input terminal; the first stage transmission signal input terminal receives the stage transmission signal of the former stage transmission module; the second stage transmission signal input terminal receives the stage transmission signal of the next stage transmission module.

2. The liquid crystal display driving circuit according to claim 1, wherein the stage transmission module comprises:

a first NAND gate, a first input terminal of the first NAND gate receiving the scan control signal output from the scan control module;

a second NAND gate, a first input terminal of the second NAND gate electrically connecting to an output terminal of the first NAND gate, a second input terminal of the first NAND gate electrically connecting to an output terminal of the second NAND gate;

a third NAND gate, a first input terminal of the third NAND gate electrically connecting to an output terminal of the second NAND gate; and a fourth NAND gate, a first input terminal of the fourth NAND gate electrically connecting to an output terminal of the third NAND gate, a second input terminal of the second NAND gate and the third NAND gate electrically connecting to an output terminal of the fourth NAND gate respectively, the second input terminal of the forth NAND gate connecting to the CKV signal, the output terminal of the fourth NAND gate outputting the stage transmission signal.

3. The liquid crystal display driving circuit according to claim 1, wherein the stage transmission module comprises:

a fifth NAND gate, a first input terminal of the fifth NAND gate receiving the scan control signal outputted from the scan control module;

a sixth NAND gate, an output terminal of the fifth NAND gate electrically connecting to a second input terminal of the fifth NAND gate and a first input terminal of the sixth NAND gate respectively;

a seventh NAND gate, a first input terminal of the seventh NAND gate electrically connecting to an output terminal of the sixth NAND gate; and a eighth NAND gate, a first input terminal of the eighth NAND gate electrically connecting to an output terminal of the seventh NAND gate, a second input terminal of the sixth NAND gate and a second input terminal of the seventh NAND gate electrically connecting to an output terminal of the eighth NAND gate respectively, the CKV signal inputted to a second input terminal of the eighth NAND gate, the output terminal of the eighth NAND gate outputting the stage transmission signal.

4. The liquid crystal display driving circuit according to claim 1, wherein first gate driving signal output submodule comprises:

a ninth NAND gate, a first input terminal of the ninth NAND gate receiving the scan control signal outputted from the scan control module and reversed by the first inverter, the CK1 signal inputted to a second output terminal of the ninth NAND gate; and a plurality of odd number of inverters configured by the connection that an input terminal of the former inverter connects to an output terminal of the latter inverter, an input terminal of the first inverter connecting to the output terminal of the ninth NAND gate, an output terminal of the last inverter outputting the gate driving signal;

wherein the second gate driving signal output submodule comprises:

a tenth NAND gate, a first input terminal of the tenth NAND gate receiving the scan control signal outputted from the scan control module and reversed by the first inverter, the CK2 signal inputted a second output terminal of the tenth NAND gate; and a plurality of odd number of inverters configured by the connection that an input terminal of the former inverter connects to an output terminal of the latter inverter, an input terminal of the first inverter connecting to the output terminal of the tenth NAND gate, an output terminal of the last inverter outputting the gate driving signal.

5. The liquid crystal display driving circuit according to claim 1, wherein the first gate driving signal output submodule comprises a first transmitter and an even number of inverters; the first transmitter comprises a P-channel enhancement type field effect transistor and a N-channel enhancement type field effect transistor; the even number of inverters configured by the connection that an input terminal of the former inverter connects with an output terminal of the latter inverter; an input terminal of the first inverter connects the source of the P-channel enhancement type field effect transistor and the source of the N-channel enhancement type field effect transistor in the first transmitter; an output terminal of the last inverter outputs the gate driving signal; the drain of the P-channel enhancement type field effect transistor and the drain of the N-channel enhancement type field effect transistor in the first transmitter connects to the CK1 signal; and wherein the second gate driving signal output submodule comprises a second transmitter and an even number of inverters; the second transmitter comprises a P-channel enhancement type field effect transistor and a N-channel enhancement type field effect transistor; the even number of inverters configured by the connection that an input terminal of the former inverter connects with an output terminal of the latter inverter; an input terminal of the first inverter connects to the source of the P-channel enhancement type field effect transistor and the source of the N-channel enhancement type field effect transistor in the second transmitter; an output terminal of the last inverter outputs the gate driving signal; the drain of the P-channel enhancement type field effect transistor and the drain of the N-channel enhancement type field effect transistor in the second transmitter connect to the CK2 signal.

6. The liquid crystal display driving circuit according to claim 1, wherein when the driving circuit is in a reverse scan state, the first stage transmission signal input terminal receives the former stage transmission signal from the stage transmission module; when the former stage transmission signal is the low voltage level, the scan control module outputs the scan control signal with the low voltage level to the input terminal of the output control signal of the gate driving signal output module and the stage transmission control signal input terminal of the stage transmission module respectively;

wherein an input terminal of the submodule output control signal of the first gate driving signal output submodule and an input terminal of the submodule output control signal of the second gate driving signal output submodule respectively receive the scan control signal with the low voltage level reversed by the first inverter; when an clock input terminal of the first gate driving signal output submodule receives the CK1 signal with the high voltage level, an clock input terminal of the second gate driving signal output submodule receives the CK2 signal with the low voltage level, the first gate driving signal output submodule outputs the driving signal to drive the gate of the current stage; when the clock input terminal of the first gate driving signal output submodule receives the CK1 signal with the low voltage level, the clock input terminal of the second gate driving signal output submodule receives the CK2 signal with the high voltage level, the second gate driving signal output submodule outputs the driving signal to drive the gate of the next stage;

wherein the stage transmission signal input terminal of the stage transmission module receives the stage transmission control signal with the low voltage level; when the clock input terminal of the stage transmission module receives the CKV signal with the low voltage level, the stage transmission module output the stage transmission signal of the current stage with the high voltage level.

7. The liquid crystal display driving circuit according to claim 6, wherein the stage transmission module further comprises a second NAND gate; when the CKV signal is high voltage level, the clock input terminal of the stage transmission receives the CKV signal with the low voltage level reversed by a second inverter.

8. The liquid crystal display driving circuit according to claim 7, wherein when the driving circuit is during the forward scan, the stage transmission signal is initiated by a low voltage level to generate the first stage and the second stage output signal with high voltage level of the liquid crystal display; when the driving circuit is during the reverse scan, the stage transmission signal is initiated by a low voltage level to generate the last stage and the last second stage output signal with high voltage level of the liquid crystal display.

9. The liquid crystal display driving circuit according to claim 1, wherein when the driving circuit is in a reverse scan state, the first stage transmission signal input terminal receives the next stage transmission signal from the stage transmission module; when the former stage transmission signal is the low voltage level, the scan control module outputs the scan control signal with the low voltage level to the input terminal of the output control signal of the gate driving signal output module and the stage transmission control signal input terminal of the stage transmission module respectively;

wherein an input terminal of the submodule output control signal of the first gate driving signal output submodule and an input terminal of the submodule output control signal of the second gate driving signal output submodule respectively receive the scan control signal with the low voltage level reversed by the first inverter; when an clock input terminal of the first gate driving signal output submodule receives the CK1 signal with the high voltage level, an clock input terminal of the second gate driving signal output submodule receives the CK2 signal with the low voltage level, the first gate driving signal output submodule outputs the driving signal to drive the gate of the stage; when the clock input terminal of the first gate driving signal output submodule receives the CK1 signal with the low voltage level, the clock input terminal of the second gate driving signal output submodule receives the CK2 signal with the high voltage level, the second gate driving signal output submodule outputs the driving signal to drive the gate of the former stage;

wherein the stage transmission signal input terminal of the stage transmission module receives the stage transmission control signal with the low voltage level; when the clock input terminal of the stage transmission module receives the CKV signal with the low voltage level, the stage transmission module output the stage transmission signal of the current stage with the high voltage level.

10. The liquid crystal display driving circuit according to claim 9, wherein the stage transmission module further comprises a second NAND gate; when the CKV signal is high voltage level, the clock input terminal of the stage transmission receives the CKV signal with the low voltage level reversed by a second inverter.

11. The liquid crystal display driving circuit according to claim 10, wherein when the driving circuit is during the forward scan, the stage transmission signal is initiated by a low voltage level to generate the first stage and the second stage output signal with high voltage level of the liquid crystal display; when the driving circuit is during the reverse scan, the stage transmission signal is initiated by a low voltage level to generate the last stage and the last second stage output signal with high voltage level of the liquid crystal display.

12. A liquid crystal display driving circuit, comprising:

a scan control module;

a gate driving signal output module; and a stage transmission module;

wherein a voltage for controlling a forward scan and a reverse scan is inputted to a control voltage level input terminal of the scan control module; a stage transmission signal input terminal of the scan control module receives a stage transmission signal of the previous stage output from the stage transmission module; an output terminal of the scan control module outputs a scan control signal to an input terminal of the output control signal of the gate driving signal output module and an stage transmission control signal input terminal of the stage transmission module respectively;

wherein the gate driving signal output module comprises a first gate driving signal output submodule, a second gate driving signal output submodule and a first inverter; the scan control module outputs the scan control signal to an input terminal of the submodule output control signal of the first gate driving signal output submodule and an input terminal of the submodule output control signal of the second gate driving signal output submodule through the first inverter; a CK1 signal is inputted to a clock input terminal of the first gate driving signal output submodule; a CK2 signal is inputted to a clock input terminal of the second gate driving signal output submodule;

wherein a CKV signal is inputted to a clock input terminal of the stage transmission module;

wherein the clock periods of the CK1 signal and CK2 signal are half of the clock period of the CKV signal; the occurrence time of the high voltage level of the CK1 signal does not overlap with the occurrence time of the high voltage level of the CK2 signal;

wherein the first gate driving signal output submodule comprises a first transmitter and an even number of inverters; the first transmitter comprises a P-channel enhancement type field effect transistor and a N-channel enhancement type field effect transistor; the even number of inverters configured by the connection that an input terminal of the former inverter connects with an output terminal of the latter inverter; an input terminal of the first inverter connects the source of the P-channel enhancement type field effect transistor and the source of the N-channel enhancement type field effect transistor in the first transmitter; an output terminal of the last inverter outputs the gate driving signal; the drain of the P-channel enhancement type field effect transistor and the drain of the N-channel enhancement type field effect transistor in the first transmitter connects to the CK1 signal; and wherein the second gate driving signal output submodule comprises a second transmitter and an even number of inverters; the second transmitter comprises a P-channel enhancement type field effect transistor and a N-channel enhancement type field effect transistor; the even number of inverters configured by the connection that an input terminal of the former inverter connects with an output terminal of the latter inverter; an input terminal of the first inverter connects to the source of the P-channel enhancement type field effect transistor and the source of the N-channel enhancement type field effect transistor in the second transmitter; an output terminal of the last inverter outputs the gate driving signal; the drain of the P-channel enhancement type field effect transistor and the drain of the N-channel enhancement type field effect transistor in the second transmitter connect to the CK2 signal.

13. The liquid crystal display driving circuit according to claim 12, wherein the stage transmission module comprises:

a first NAND gate, a first input terminal of the first NAND gate receiving the scan control signal output from the scan control module;

a second NAND gate, a first input terminal of the second NAND gate electrically connecting to an output terminal of the first NAND gate, a second input terminal of the first NAND gate electrically connecting to an output terminal of the second NAND gate;

a third NAND gate, a first input terminal of the third NAND gate electrically connecting to an output terminal of the second NAND gate; and a fourth NAND gate, a first input terminal of the fourth NAND gate electrically connecting to an output terminal of the third NAND gate, a second input terminal of the second NAND gate and the third NAND gate electrically connecting to an output terminal of the fourth NAND gate respectively, the second input terminal of the forth NAND gate connecting to the CKV signal, the output terminal of the fourth NAND gate outputting the stage transmission signal.

14. The liquid crystal display driving circuit according to claim 12, wherein the stage transmission module comprises:

a fifth NAND gate, a first input terminal of the fifth NAND gate receiving the scan control signal outputted from the scan control module;

a sixth NAND gate, an output terminal of the fifth NAND gate electrically connecting to a second input terminal of the fifth NAND gate and a first input terminal of the sixth NAND gate respectively;

a seventh NAND gate, a first input terminal of the seventh NAND gate electrically connecting to an output terminal of the sixth NAND gate; and a eighth NAND gate, a first input terminal of the eighth NAND gate electrically connecting to an output terminal of the seventh NAND gate, a second input terminal of the sixth NAND gate and a second input terminal of the seventh NAND gate electrically connecting to an output terminal of the eighth NAND gate respectively, the CKV signal inputted to a second input terminal of the eighth NAND gate, the output terminal of the eighth NAND gate outputting the stage transmission signal.

15. A liquid crystal display driving circuit, comprising:

a scan control module;

a gate driving signal output module; and a stage transmission module;

wherein a voltage for controlling a forward scan and a reverse scan is inputted to a control voltage level input terminal of the scan control module; a stage transmission signal input terminal of the scan control module receives a stage transmission signal of the previous stage output from the stage transmission module; an output terminal of the scan control module outputs a scan control signal to an input terminal of the output control signal of the gate driving signal output module and an stage transmission control signal input terminal of the stage transmission module respectively;

wherein the gate driving signal output module comprises a first gate driving signal output submodule, a second gate driving signal output submodule and a first inverter; the scan control module outputs the scan control signal to an input terminal of the submodule output control signal of the first gate driving signal output submodule and an input terminal of the submodule output control signal of the second gate driving signal output submodule through the first inverter; a CK1 signal is inputted to a clock input terminal of the first gate driving signal output submodule; a CK2 signal is inputted to a clock input terminal of the second gate driving signal output submodule;

wherein a CKV signal is inputted to a clock input terminal of the stage transmission module;

wherein the clock periods of the CK1 signal and CK2 signal are half of the clock period of the CKV signal; the occurrence time of the high voltage level of the CK1 signal does not overlap with the occurrence time of the high voltage level of the CK2 signal;

wherein the stage transmission module comprises:

a first NAND gate, a first input terminal of the first NAND gate receiving the scan control signal output from the scan control module;

a second NAND gate, a first input terminal of the second NAND gate electrically connecting to an output terminal of the first NAND gate, a second input terminal of the first NAND gate electrically connecting to an output terminal of the second NAND gate;

a third NAND gate, a first input terminal of the third NAND gate electrically connecting to an output terminal of the second NAND gate; and a fourth NAND gate, a first input terminal of the fourth NAND gate electrically connecting to an output terminal of the third NAND gate, a second input terminal of the second NAND gate and the third NAND gate electrically connecting to an output terminal of the fourth NAND gate respectively, the second input terminal of the forth NAND gate connecting to the CKV signal, the output terminal of the fourth NAND gate outputting the stage transmission signal;

or, wherein the stage transmission module comprises:

a fifth NAND gate, a first input terminal of the fifth NAND gate receiving the scan control signal outputted from the scan control module;

a sixth NAND gate, an output terminal of the fifth NAND gate electrically connecting to a second input terminal of the fifth NAND gate and a first input terminal of the sixth NAND gate respectively;

a seventh NAND gate, a first input terminal of the seventh NAND gate electrically connecting to an output terminal of the sixth NAND gate; and a eighth NAND gate, a first input terminal of the eighth NAND gate electrically connecting to an output terminal of the seventh NAND gate, a second input terminal of the sixth NAND gate and a second input terminal of the seventh NAND gate electrically connecting to an output terminal of the eighth NAND gate respectively, the CKV signal inputted to a second input terminal of the eighth NAND gate, the output terminal of the eighth NAND gate outputting the stage transmission signal.

16. The liquid crystal display driving circuit according to claim 15, wherein first gate driving signal output submodule comprises:

a ninth NAND gate, a first input terminal of the ninth NAND gate receiving the scan control signal outputted from the scan control module and reversed by the first inverter, the CK1 signal inputted to a second output terminal of the ninth NAND gate; and a plurality of odd number of inverters configured by the connection that an input terminal of the former inverter connects to an output terminal of the latter inverter, an input terminal of the first inverter connecting to the output terminal of the ninth NAND gate, an output terminal of the last inverter outputting the gate driving signal;

wherein the second gate driving signal output submodule comprises:

a tenth NAND gate, a first input terminal of the tenth NAND gate receiving the scan control signal outputted from the scan control module and reversed by the first inverter, the CK2 signal inputted a second output terminal of the tenth NAND gate; and a plurality of odd number of inverters configured by the connection that an input terminal of the former inverter connects to an output terminal of the latter inverter, an input terminal of the first inverter connecting to the output terminal of the tenth NAND gate, an output terminal of the last inverter outputting the gate driving signal.

* * * * *